US008202015B2

(12) United States Patent
Peck et al.

(10) Patent No.: US 8,202,015 B2
(45) Date of Patent: Jun. 19, 2012

(54) MEDIA TRAY ASSEMBLY AND A PRINTER HAVING THE SAME

(75) Inventors: Choon Siang Peck, Singapore (SG); Shivaprasad AradhyA.B.S., Singapore (SG); Wan Yen Bernice Ong, Singapore (SG)

(73) Assignee: Hewlett-Packard Development Company, L.P., Houston, TX (US)

( * ) Notice: Subject to any disclaimer, the term of this patent is extended or adjusted under 35 U.S.C. 154(b) by 1167 days.

(21) Appl. No.: 11/769,690

(22) Filed: Jun. 27, 2007

(65) Prior Publication Data

US 2009/0002965 A1 Jan. 1, 2009

(51) Int. Cl.
*B41J 29/02* (2006.01)

(52) U.S. Cl. ..... 400/693; 400/691; 400/718; 271/162

(58) Field of Classification Search ..... 347/8, 16, 347/108, 104; 399/391, 393, 402, 405; 271/162; 400/693, 718, 691
See application file for complete search history.

(56) References Cited

U.S. PATENT DOCUMENTS

| | | | | |
|---|---|---|---|---|
| 4,600,255 | A | 7/1986 | Dubarko | |
| 5,454,553 | A * | 10/1995 | Firl et al. | 271/4.04 |
| 5,603,493 | A | 2/1997 | Kelly | |
| 5,680,166 | A | 10/1997 | Nishiberi | |
| 5,775,687 | A | 7/1998 | Nakatani et al. | |
| 6,428,228 | B1 | 8/2002 | McKay et al. | |
| 6,830,401 | B1 * | 12/2004 | Hwang et al. | 400/693 |
| 7,073,787 | B2 | 7/2006 | Kinsley et al. | |
| 2004/0169327 | A1 * | 9/2004 | Swayze et al. | 271/145 |
| 2005/0225025 | A1 * | 10/2005 | Chikumoto | 271/162 |
| 2006/0210346 | A1 | 9/2006 | Bandou | |

* cited by examiner

*Primary Examiner* — Judy Nguyen
*Assistant Examiner* — Shema Freeman

(57) ABSTRACT

A media tray assembly for a printer includes an output tray that is removably and pivotally mounted onto an input tray. The output tray is configured such that it can be easily installed into and quickly removed from the printer. In addition, the output tray can be pivoted upward from a substantially horizontal position and latched into an inclined position in one continuous motion by a user.

13 Claims, 5 Drawing Sheets

MEDIA TRAY ASSEMBLY AND A PRINTER HAVING THE SAME

FIELD OF THE INVENTION

The present invention generally relates to a media tray assembly for a printer, particularly a desktop printer.

BACKGROUND

Conventional desktop image forming apparatuses, such as inkjet printers, have paper input and output trays that are removable or permanently attached. The input tray is adapted to support a stack of media sheets and the output tray is adapted to receive the sheets after printing. In order to minimize the printer footprint, many desktop printers are provided with an input/output tray assembly at the front of the printer, wherein the output tray is positioned above the input tray. In order to load media sheets into the input tray, the output tray has to be lifted away from the input tray or removed. Therefore, it would be an advantage to have an output tray that is user-friendly. To be user-friendly, the output tray should be easily lifted away from the input tray and maintained at the lifted position without much effort by the user so that it is not necessary to remove the output tray from the printer for loading media sheets. Furthermore, the output tray should be easily installed into and easily removed from the printer. One of the drawbacks associated with conventional output tray designs is that these designs are not able to meet all of the above mentioned criteria.

SUMMARY

The present invention provides a media tray assembly for a printer, having an output tray that is removably and pivotally mounted onto an input tray. The output tray is configured such that it can be easily installed into and quickly removed from the printer. In addition, the output tray can be pivoted upward from a substantially horizontal position and latched into an inclined position in one continuous motion by a user.

DETAILED DESCRIPTION

Figure 1:
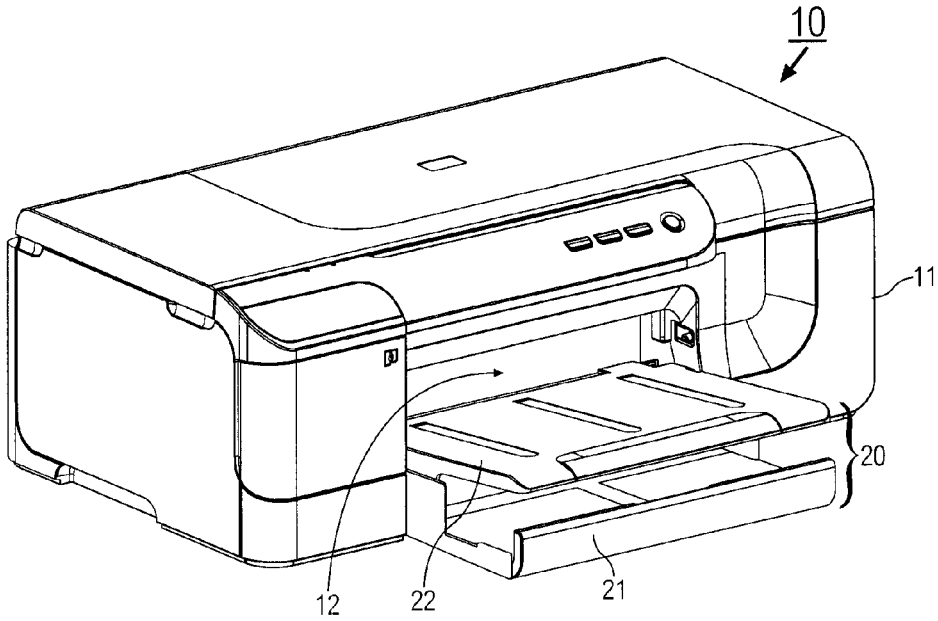
FIG. 1 is an isometric view of a desktop printer having a media tray assembly according to an embodiment of the present invention.

FIG. 1 shows a desktop printer 10 having a tray assembly 20 according to an embodiment of the present invention. The desktop printer 10 may be a stand-alone inkjet printer or an "all-in-one" (i.e. multifunction) printer, which has printing, faxing and scanning capability. The printer 10 has a printer housing 11 with a frontal access opening 12. The tray assembly 20 is inserted into the printer 10 through the frontal access opening 12. The tray assembly 20 includes an input tray 21 for holding a supply of media sheets and a removable output tray 22 for receiving printed media sheets. In a typical printing cycle, a media sheet is picked up from the input tray 21, fed through a printing zone, and then the printed sheet is discharged onto the output tray.

Figure 2:
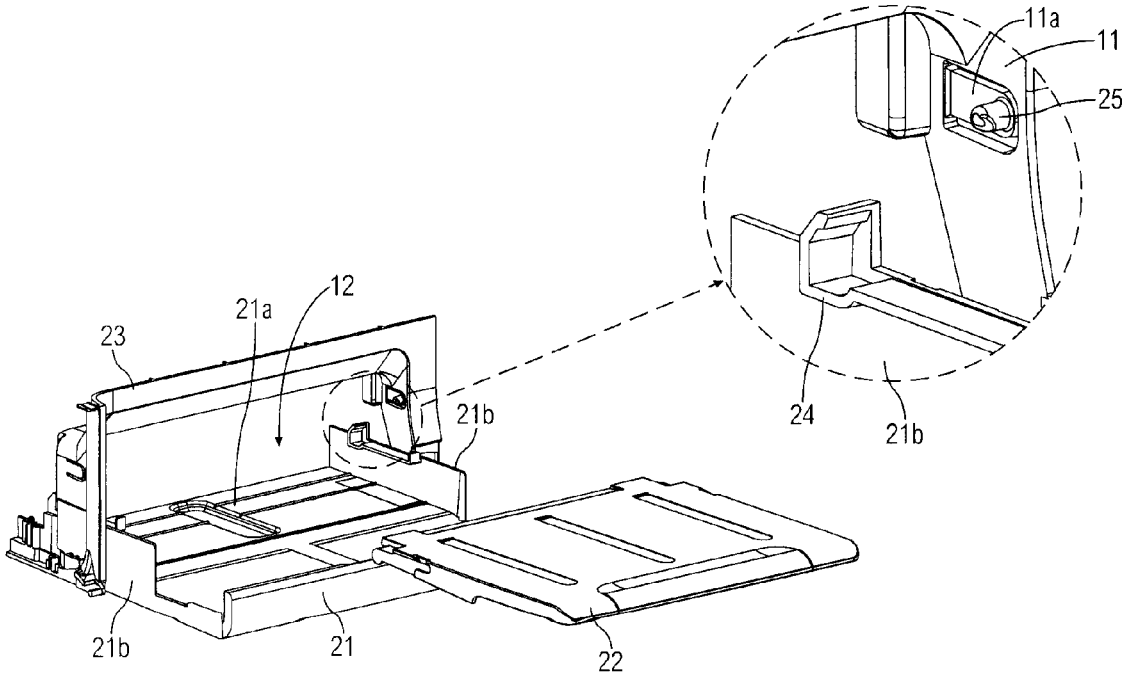
FIG. 2 shows the main components of the tray assembly, including an input tray and an output tray.

FIG. 2 shows the main components of the tray assembly 20 with the output tray disengaged from the input tray 21. The input tray 21 is fixedly attached to the printer housing 11. To simplify illustration, only a portion of the printer housing 11 is shown in FIG. 2. Alternatively, the input tray 21 may be attached to a support frame structure, which is connected to the printer housing. The input tray 21 has a base 21*a* and two opposing side walls 21*b*. Each side wall 21*b* of the input tray 21 is provided with a sliding slot 24, which is configured to engage the output tray 22 in a manner to be described subsequently. At a location above each sliding slot 24, there is a flexible projection 25 projecting from a deflectable tab 11*a*, which is integrally formed as part of the printer housing 11. The flexible projections 25 are made of a resilient thermoplastic material, for example, polyvinyl chloride (PVC) or acrylonitrile butadiene styrene (ABS), and are molded onto the deflectable tabs 11*a*. The deflectable tabs 11*a* and the projections 25 are positioned so as to enable the output tray 22 to be retained at an inclined position.

Figure 3:
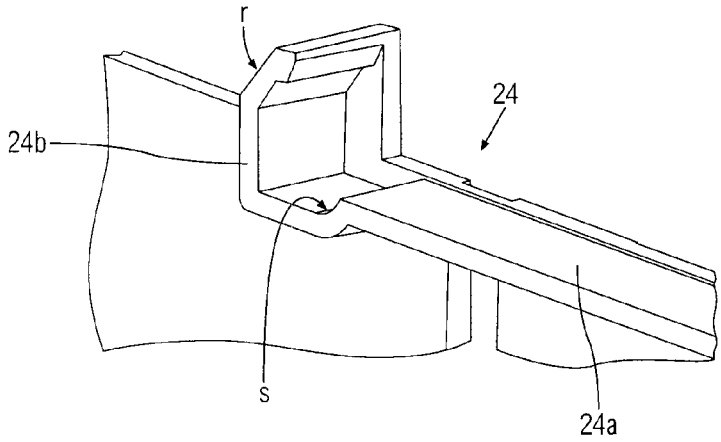
FIG. 3 shows a sliding slot on the input tray.
Figure 4:
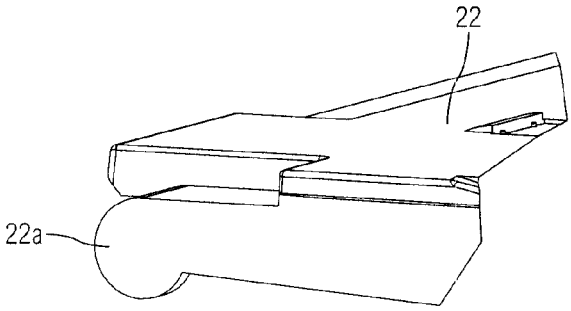
FIG. 4 shows a rotating member at a corner section of the output tray.
Figure 5:
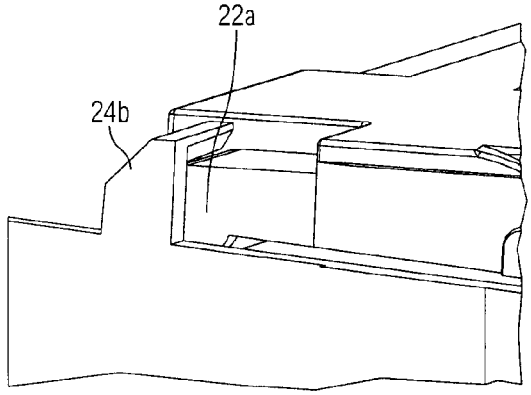
FIG. 5 shows a rotating member of the output tray engaging a sliding slot in the input tray.

Referring to FIG. 3, each sliding slot 24 includes an elongated sliding surface 24*a* and a retaining portion 24*b*. Referring to FIG. 4, the output tray 22 is configured so that there are two rotating members 22*a* integrally formed at two opposing corners of the output tray (only one of which is visible in FIG. 4). Each rotating member 22*a* has an arcuate rolling surface that is semi-cylindrical in configuration to enable rotation. The output tray 22 is removably mounted onto the side walls 21*b* of the input tray 21 by sliding the two rotating members 22*a* along the sliding surfaces 24*a* of the sliding slots 24 until the rotating members 22*a* are received by the retaining portions 24*b* of the sliding slots 24 as shown in FIG. 5. Referring again to FIG. 3, each retaining portion 24*b* is shaped so as to receive the corresponding rotating member 22*a* while allowing the rotating member 22*a* to rotate, thereby enabling the output tray 22 to pivot relative to the input tray 21. The retaining portion 24*b* has a sloping surface s that slopes downwardly from the sliding surface 24*a* and is configured to prevent the output tray 22 from sliding too much while the output tray 22 is pivoting upward. In addition, the retaining portion 24*b* also includes an upper inclined overhang r, which acts as a stopper for limiting the rotation of the output tray 22, i.e. preventing the output tray 22 from rotating beyond a desired angle.

Figure 6:
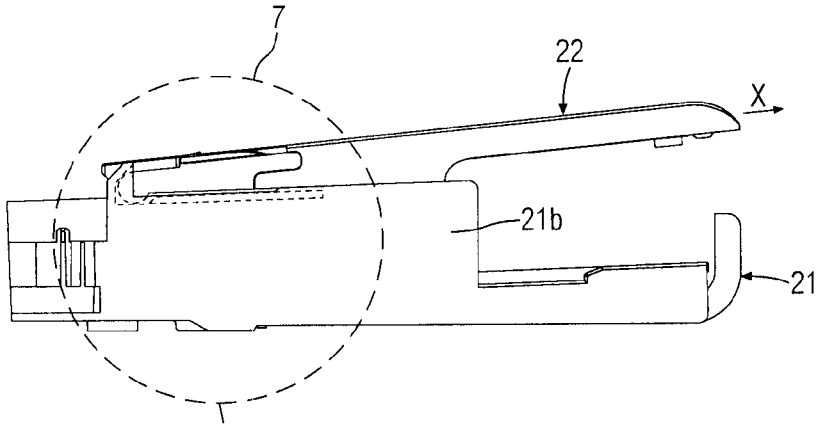
FIG. 6 is a side view of the tray assembly showing the output tray in a substantially horizontal position.

FIG. 6 shows the output tray 22 being mounted onto the input tray 21 and in a substantially horizontal position (hereafter simply referred to as "horizontal position"), which is an operative position for receiving printed/discharged media sheets. From the horizontal position, the output tray 22 can be disengaged from the input tray 21 by pulling the output tray 22 laterally (in the direction shown by arrow X) to thereby cause the rotating members 22*a* of output tray 22 to slide out of engagement with the retaining portions 24*b* of the sliding slots 24.

Figure 7:
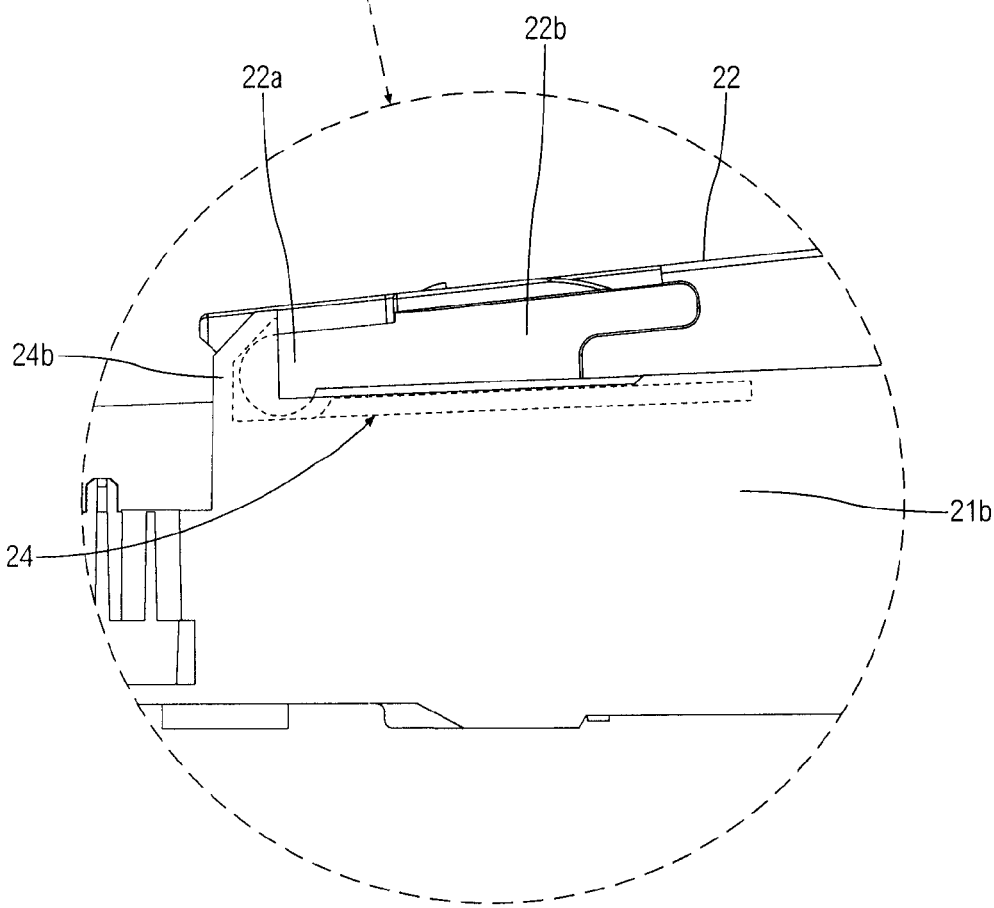
FIG. 7 is an exploded view of section 7 shown in FIG. 6.
Figure 8:
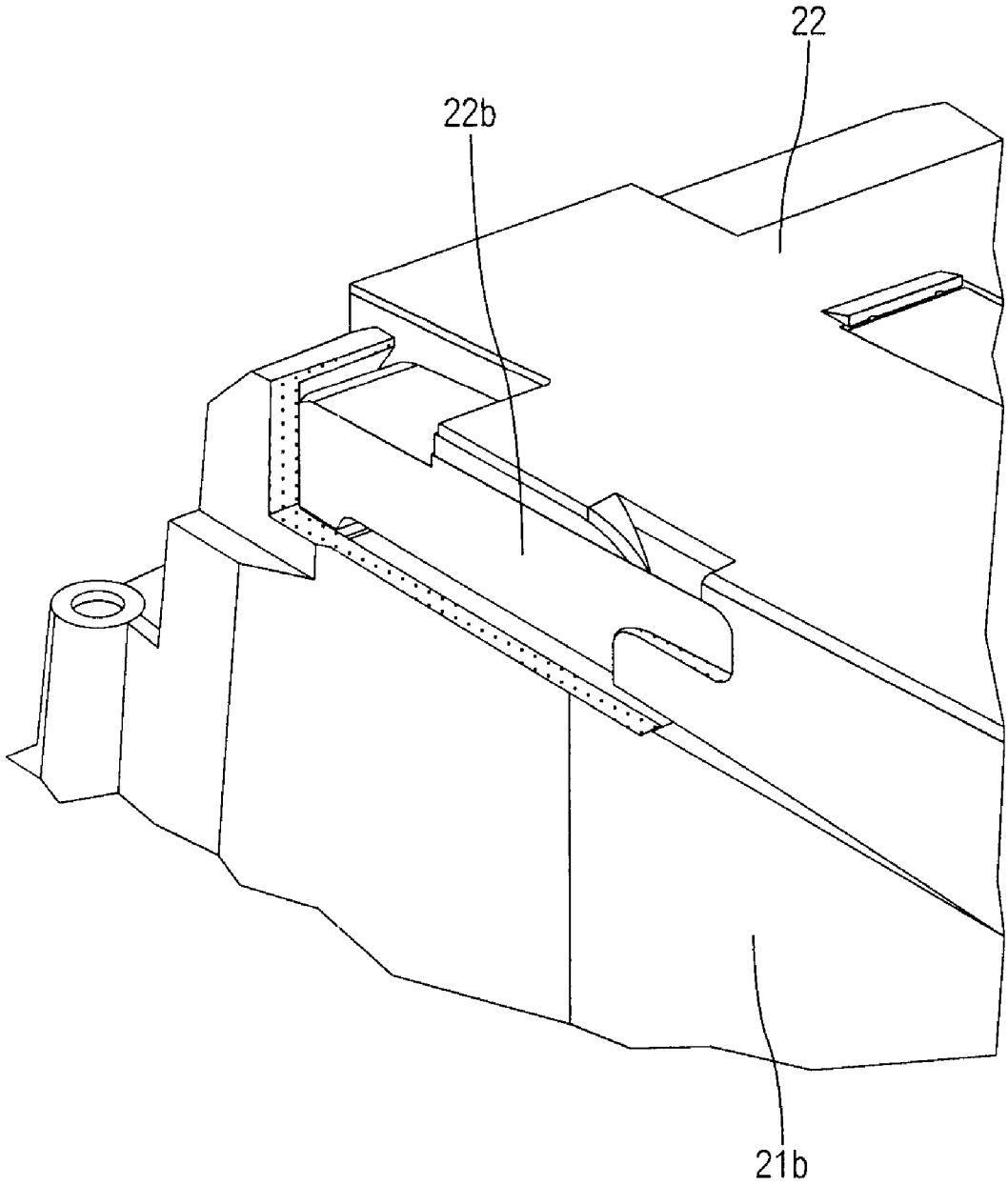
FIG. 8 is an isometric view showing a recess formed at a side edge of the tray assembly.
Figure 9:
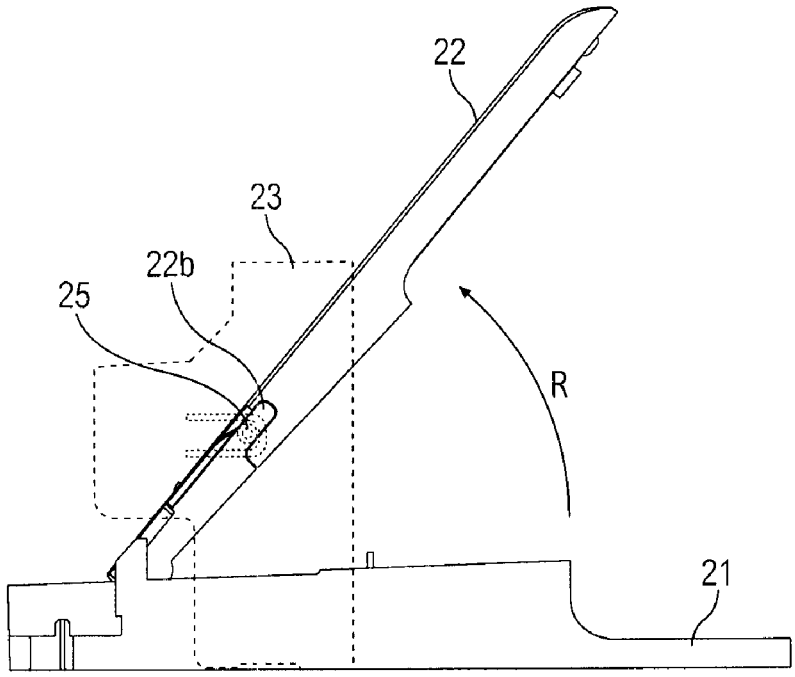
FIG. 9 is a side view showing the output tray in an inclined position.

Referring to FIG. 7, an elongated recess 22*b* is formed at each side edge of the output tray 22 at a location adjacent to the rotating member 22*a*. FIG. 8 provides an isometric view of the recess 22*a*. As shown in FIG. 9, the recess 22*b* is configured to receive a corresponding projection 25 such that the output tray can be held at a desired inclined angle.

The output tray 22 is pivotable between the horizontal position shown in FIG. 6 and the inclined position shown in FIG. 9. From the horizontal position, the output tray can be lifted upward (i.e. pivoted in direction R shown in FIG. 9) and latched onto the projections 25 in one continuous motion by a user. The flexible property of the projections 25 allows the projections to be elastically bent by the side edges of the output tray 22 and snapped into the recesses 22*b*. When the projections 25 are being snapped into the recesses 22*b* of the output tray 22, the deflectable tabs 11*a* deflect slightly away from the side edges of the output tray 22 in order to facilitate the snapping of the projections 25 into the recesses 22*b*. When the output tray 22 is in the inclined position, the user can load a supply of media sheets onto the input tray 21. To move the output tray 22 from the inclined position back to the horizontal position, the user can simply push the output tray 22 downward to quickly release the output tray 22 from the projections 25.

Figure 10:
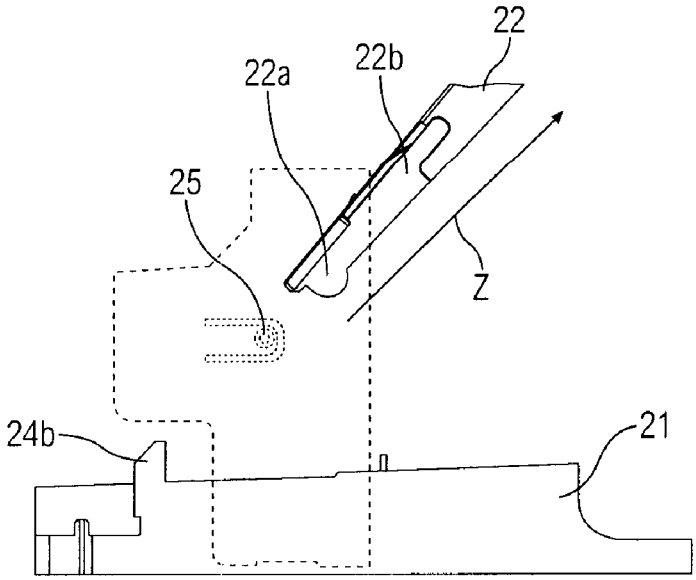
FIG. 10 shows the output tray being removed from the inclined position.

Referring to FIG. 10, the user can also remove the output tray 22 when the output tray 22 is in the inclined position by pulling the output tray 22 in the direction shown by arrow Z to thereby disengage the rotating members 22*a* of output tray 22 from the retaining portions 24*b* of sliding slots 24 and to disengage the projections 25 from the recesses 22*b* at the side edges of the output tray 22.

One advantage of the tray assembly described above is that the output tray 22 can be assembled onto the input tray 21 by a quick-release hinge arrangement that does not require hinge pins or other fasteners. Furthermore, the output tray 22 can be easily removed in one step when the output tray is in the horizontal position or the inclined position. Yet another advantage is that the output tray 22 can be lifted upward and latched onto the projections 25 in one continuous motion by a user, and then pushed back into the horizontal position in one easy step. All of these features are not possible with conventional output tray designs.

While particular embodiments of the present invention have been described, it will be understood by those skilled in the art that modifications and substitutions can be made without departing from the scope of the invention as set forth in the following claims.

What is claimed is:

1. A media tray assembly for a printer comprising:

an input tray having two opposing side walls, each side wall being provided with a sliding slot;

a removable output tray having two opposing side edges and two rotating members integrally formed at two opposing corners of the output tray, each of said rotating members having an arcuate surface to enable rotation, wherein said sliding slots are configured so as to enable the rotating members of said output tray to slide into engagement or slide out of engagement therewith, and when said rotating members are engaging said sliding slots, said output tray is pivotable between a substantially horizontal position and an inclined position relative to the input tray; and a pair of flexible projections disposed at locations above the sliding slots so as to come into engagement with the opposing side edges of the output tray when the output tray reaches said inclined position after being pivoted away from said substantially horizontal position, wherein said pair of flexible projections deflect in response to engagement with said pivoting output tray so as to then hold and to retain the output tray at the inclined position, wherein said output tray is manually pivotable from the substantially horizontal position and latched onto the projections in one continuous motion by a user.

2. The media tray assembly of claim 1, wherein the output tray has an elongated recess formed at each side edge, said recess being configured to receive a corresponding projection.

3. The media tray assembly of claim 1, wherein each sliding slot comprises an elongated sliding surface and a retaining portion configured to rotatably engage a corresponding rotating member of the output tray, whereby the tray is slidable into engagement with the sliding slot by sliding the rotating members of the output tray on the sliding surfaces until the rotating members are received by the retaining portions.

4. The media tray assembly of claim 3, wherein said retaining portion of the sliding slot includes a sloped surface that slopes downwardly from the sliding surface for limiting the sliding movement of the rotating member when the output tray is pivoting.

5. The media tray assembly of claim 3, wherein said retaining portion of the sliding slot is shaped so as to limit the rotation of the output tray.

6. The media tray assembly of claim 1, wherein said flexible projections are made of a thermoplastic material.

7. A printer comprising:

a housing having a frontal access opening;

an input tray inserted in said frontal access opening and attached to said housing, said input tray having two opposing side walls, each side wall being provided with a sliding slot;

an output tray removably mounted onto the side walls of said input tray, said output tray having two opposing side edges and two rotating members integrally formed at two opposing corners of the output tray, each of said rotating members having an arcuate surface to enable rotation, wherein the sliding slots on the input tray are configured so as to enable the rotating members of the output tray to slide into engagement or slide out of engagement therewith, and when the rotating members are engaging the sliding slots, the output tray is pivotable between a substantially horizontal position and an inclined position relative to the input tray; and a pair of flexible projections disposed on the housing at locations above the sliding slots so as to come into engagement with the opposing side edges of the output tray when the output tray reaches said inclined position after being pivoted away from said substantially horizontal position, wherein said pair of flexible projections deflect in response to engagement with said pivoting output tray so as to then hold and to retain the output tray at the inclined position, wherein the output tray is manually pivotable from the substantially horizontal position and latched onto the flexible projections in one continuous motion by a user.

8. The printer of claim 7, wherein the output tray has an elongated recess formed at each side edge, said recess being configured to receive a corresponding projection.

9. The printer of claim 8, wherein each projection is disposed on a deflectable tab, which is integrally formed as part of the housing, and the deflectable tabs are deflectable away from the side edges of the output tray when the projections are being snapped into the recesses.

10. The printer of claim 9, wherein each projection is molded onto a corresponding deflectable tab.

11. The printer of claim 9, wherein the output tray is latched onto the projections by snapping the projections into the recesses at the side edges of the output tray.

12. A printer with a media tray assembly comprising:

a housing;

an input tray for supporting print media as said print media is feed into said housing of said printer;

a removable output tray having two rotating members integrally formed at two opposing corners of the output tray, each of said rotating members having an arcuate surface to enable rotation, wherein said output tray is rotatable on said rotating members between a substantially horizontal position and an inclined position relative to the input tray; and at least one flexible projection being positioned to come into engagement with an edge of the output tray when the output tray reaches said inclined position after being pivoted away from said substantially horizontal position, wherein said at least one flexible projection deflects in response to engagement with said moving output tray so as to then hold and to retain the output tray at the inclined position, wherein said output tray is manually rotatable from the substantially horizontal position and latched onto the at least one flexible projection in one continuous motion by a user.

13. The assembly of claim 12, wherein the at least one projection is disposed on a deflectable tab which is deflectable away from the edge of the output tray when the projection is being engaged with the edge of the output tray.

* * * * *